US005158501A

United States Patent [19]

Proskiw

[11] Patent Number: 5,158,501

[45] Date of Patent: Oct. 27, 1992

[54] BELOW GRADE HEAT RECOVERY VENTILATOR

[75] Inventor: Gary Proskiw, Winnipeg, Canada

[73] Assignee: Unies Ltd., Winnipeg, Canada

[21] Appl. No.: 642,890

[22] Filed: Jan. 18, 1991

[51] Int. Cl.[5] ..... F24F 7/06

[52] U.S. Cl. ..... 454/341; 454/909

[58] Field of Search ..... 52/161.5; 98/34.1, 42.02, 98/42.04, 42.06, 42.12; 405/128, 229, 131; 454/909

[56] References Cited

U.S. PATENT DOCUMENTS

| | | | |
|---|---|---|---|
| 4,620,398 | 11/1986 | Wallin | 98/42.02 X |
| 4,773,309 | 9/1988 | Walters | 98/31.6 |
| 4,885,984 | 12/1989 | Franceus | 98/42.02 |
| 4,949,626 | 8/1990 | Townsend et al. | 52/169.5 X |

OTHER PUBLICATIONS

Michael Lafavore, *Radon: the invisible threat*, 1987, pp. 134–190.

*Radon Reduction in New Construction: An Interim Guide*, OPA-87-009, United State Environmental Protection Agency, Aug. 1987.

*Primary Examiner*—Harold Joyce

*Attorney, Agent, or Firm*—Murray E. Thrift; Stanley G. Ade; Adrian D. Battison

[57] ABSTRACT

A below grade heat recovery system discharges air into the drainage system below the floor slab and around the perimeter of a house or building. This air may be warm and moisture laden air ventilated from the building so that a portion of its energy content will be transferred to the surrounding soil, thus raising the soil temperature and reducing below grade heat losses. Pressurization of the sub-soil layer will reduce radon and soil gas transport from the soil, through the floor slab into the basement. Reduced foundation movement will also be reduced by the supply of a relatively constant flow moisture into the soil with the discharged air.

10 Claims, 3 Drawing Sheets

BELOW GRADE HEAT RECOVERY VENTILATOR

FIELD OF THE INVENTION

The present invention relates to heat recovery ventilation systems for buildings and more particularly to a below grade heat recovery ventilation system.

BACKGROUND OF THE INVENTION

Adequate ventilation is of importance in any building to avoid the accumulation of noxious substances. Building ventilators are found in a number of forms. These include simple fan mechanisms drawing stale air, humid air and fumes from a kitchen, bathroom or other suitable location and discharging it to the outside. These systems include heat recovery ventilators with heat exchange for exchanging heat between discharging stale air and incoming fresh air.

In addition, it is known that some buildings may be subject to infiltration and accumulation of harmful radon or soil gases in below grade parts of the buildings, for example basements. Various techniques have been developed for preventing or reducing this gas infiltration or accumulation.

It is also known that in some soils, a loss of moisture will cause the soil to contract, causing stability problems in some buildings.

The present invention is concerned with a novel heat recovery system that maybe associated with a ventilation system and that also addresses the gas infiltration and soil stability problems, at least to some extent.

SUMMARY OF THE INVENTION

According to the present invention there is provided a below grade heat recovery system for a building having a below grade floor slab, said system comprising:

at least one inlet for receiving air;

an air receiver positioned below the floor slab;

air distribution means leading from the air receiver under the floor slab and having openings therein for discharging air therefrom; and blower means for drawing air into the inlet and discharging the air into the air receiver.

The system may discharge all of the exhausted air into the soil under the floor slab drainage lines or it may also discharge into the conventional drainage tile.

The inlet may be one or more exhaust vents for receiving air from within the building.

Since exhaust air from the building is normally warm and humid, a portion of its energy content will be transferred to the surrounding soil beneath the floor slab and around the perimeter of the foundation. This raises the temperature of the soil and thus reduces the below grade heat loss from the basement.

By pressurizing the under slab drainage layer, the transport of radon and soil gas from the soil, through the slab and into the basement may be reduced.

The system also delivers a relatively constant supply of moisture into the soil, as moist air. In moisture sensitive soil, this will moderate fluctuations in the soil moisture content, thus moderating soil movement and foundation damage.

In other embodiments of the invention the inlet may be from an attic to provide attic ventilation or from outside the building to provide a "precharging" or storage of heat in the subsoil.

BRIEF DESCRIPTION OF THE DRAWINGS

In the accompanying drawings which illustrate exemplary embodiments of the present invention.

DETAILED DESCRIPTION

Figure 2:
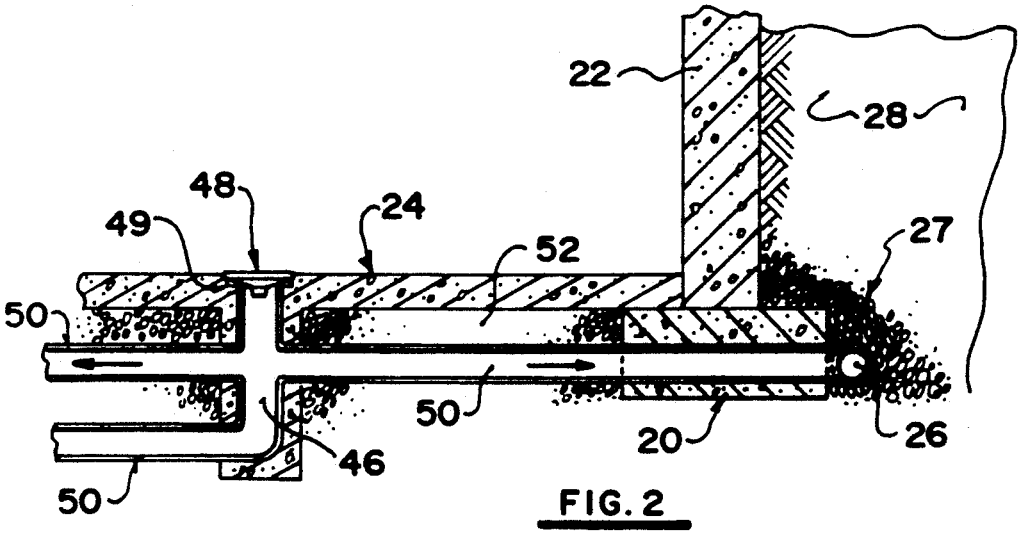
FIG. 2 is a cross sectional detail of the footing and slab.
Figure 3:
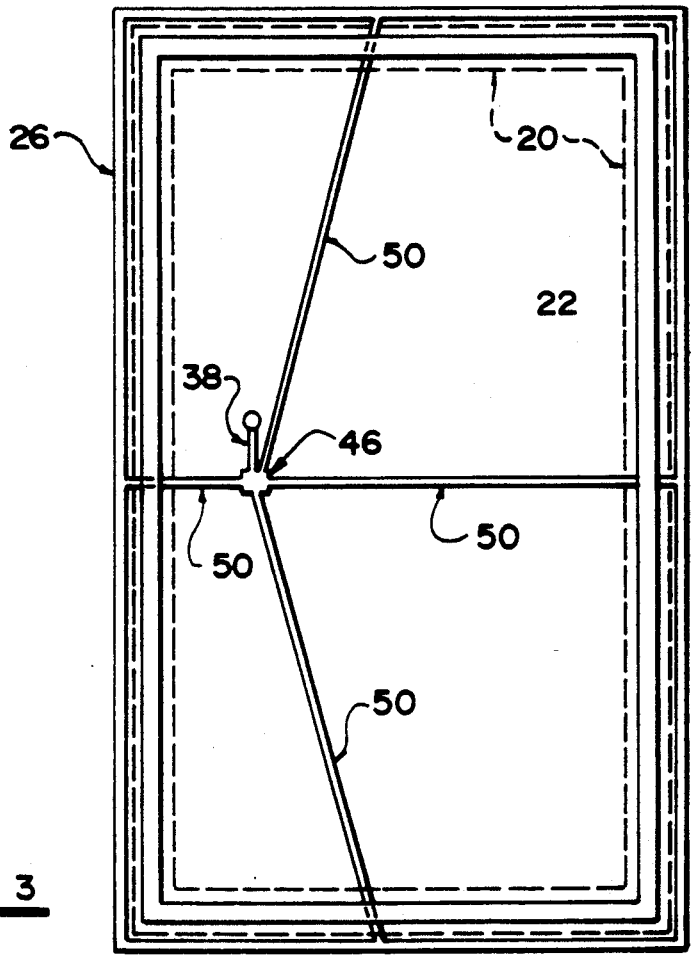
FIG. 3 plan view of the below slab-layout.

Referring to the accompanying drawings, and especially to FIGS. 2 and 3, there is illustrated a building 10, in this case a residence with a main floor level 12 containing a kitchen 14 and a bathroom 16. The house is built with a below grade basement 18. A peripheral footing 20 supports the foundation wall 22 and the edges of a floor slab 24. A conventional weeping tile 26 is installed around the footing 20.

The tile is covered with gravel 27 and then backfill soil 28.

Figure 1:
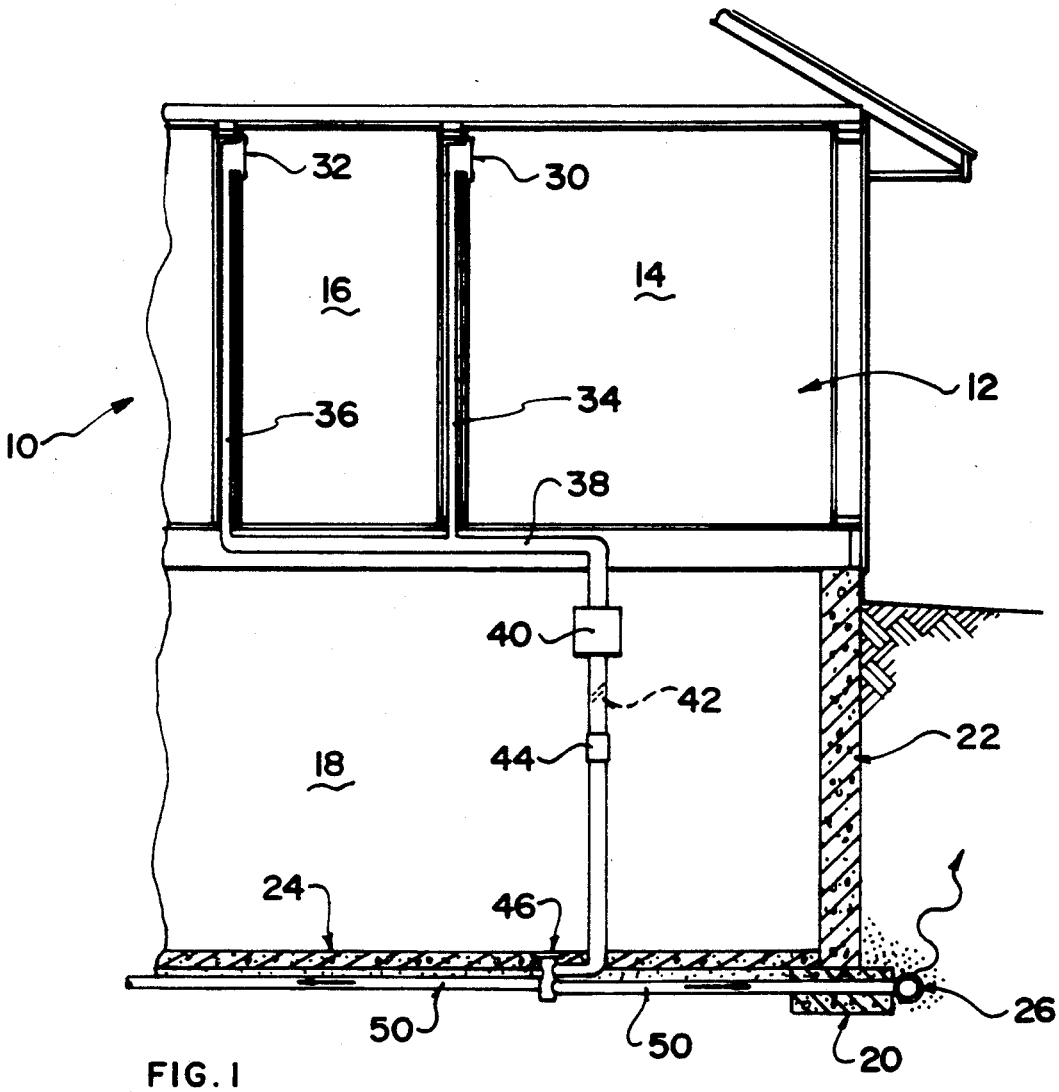
FIG. 1 is a sectional view of a house equipped with a ventilating system according to the present invention.

As illustrated in FIG. 1, the kitchen 14 is equipped with a kitchen vent 30 for ventilating moisture and fumes from the kitchen. The bathroom 16 is equipped with a bathroom vent 32, likewise for ventilating moisture and other air borne materials, for example, malodorous gases, from the bathroom. The vents 30 and 32 are connected to respective ducts 34 and 36 that lead through the walls and under the main floor to join into a main duct 38 at the basement ceiling. The main duct is equipped with a blower 40 for drawing air through the vents 30 and 32. Downstream of the blower are a balancing damper 42 and a flow measuring station 44.

From the flow measuring station, the main duct 38 leads to a catch basin 46 in the floor slab 24. The catch basin is closed with a cover 48 that is sealed in place by a seal schematically illustrated at 49 in FIG. 2.

Four leader pipes 50 lead from the catch basin 46 through a bed of gravel 52 under the slab 24. These leader pipes lead to the weeping tile 26. Each pipe has a series of holes where it passes through the gravel under the slab for leading air from the ventilation system into the gravel layer. Air is also ducted through the weeping tile into the soil around the foundation wall.

Figure 4:
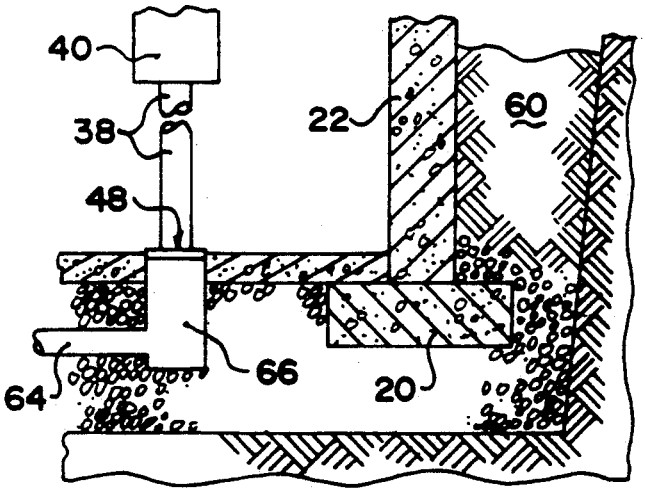
FIG. 4 is a view like FIG. 2 of an alternative embodiment.
Figure 5:
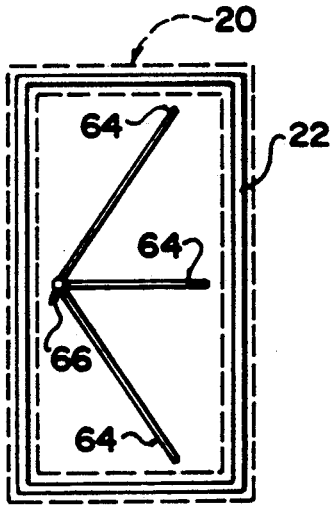
FIG. 5 is a view like FIG. 3 of the alternative embodiment of FIG. 4.
Figure 6:
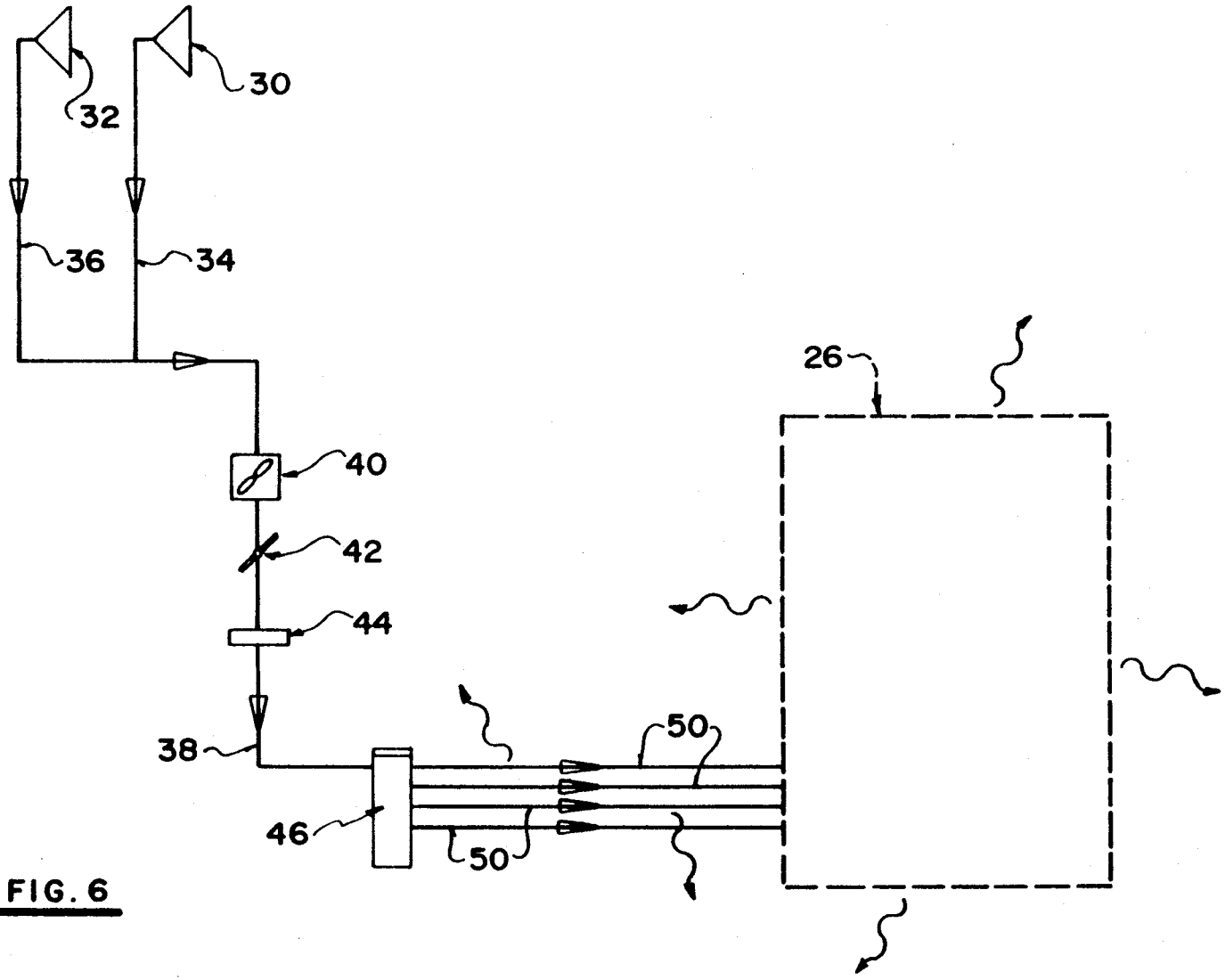
FIG. 6 is a schematic of the system of FIGS. 1, 2 and 3.

An alternative embodiment of the present invention is illustrated in FIGS. 4 and 5 of the drawings where the footing is embedded in a more extensive gravel drain layer that extends under the floor slab around the footing, below the backfill 60. In this case, there is no weeping tile around the perimeter of the footing and the underslab leaders 64 radiating from the catch basin 66 terminate short of the footing.

In the second embodiment, there will be a greater pressurization of the under slab area because the exhaust air is discharged into the zone under the slab.

While particular embodiments of the present invention have been described in the foregoing detailed description, it is to be understood that other embodiments are possible within the scope of the invention. For example, the source of air may be a warm attic in the summer, or even an inlet for ambient air.

Thus, the invention is to be considered limited solely by the scope of the appended claims.

What is claimed is:

1. In a building having:

a basement including a foundation wall and a below grade basement floor slab surrounded by the foundation wall;

a below grade drainage system including drainage tile around the foundation wall adjacent the floor slab, drainage means in the floor slab and drain lines below the floor slab, leading from the drainage means to the drain tile; and a ventilation system including an air inlet inside the building, an air discharge duct leading from the air inlet to the outside of the building and blower means for drawing air into the air discharge duct through the air inlet and blowing the air through the air discharge duct, the improvement wherein:

the air discharge duct is connected to the drainage means whereby air exhausted from the building is delivered through the drain lines below the basement floor slab to the drain tile.

2. A building according to claim 1 wherein the drainage means comprises a catch basin in the floor slab and means for sealing closed the catch basin.

3. A building according to claim 2 wherein the drain tile is perforated weeping tile adjacent the floor slab.

4. A building according to claim 1 including a balancing damper between the blower means and the drainage means.

5. A building according to claim 4 including flow measuring means between the blower means and the drainage means.

6. A building according to claim 1 including plural exhaust vents coupled to the blower means.

7. In a building having:

a peripheral below grade footing;

a below grade floor slab supported on the footing;

a foundation wall supported on the footing;

a drainage layer below the slab;

a drainage system comprising a weeping tile around the floor slab, adjacent the footing;

a catch basin in the floor slab;

drain lines leading from the catch basin to the weeping tile through the drainage layer;

at least one exhaust vent opening into the building;

duct means leading from the exhaust vent to outside of the building; and a blower for drawing air from the exhaust vent and discharging it through the duct means, the improvement comprising:

seal means for sealing the catch basin to the floor slab;

perforations in the drain lines; and means connecting the exhaust duct means to the catch basin below the seal means.

8. The invention according to claim 7 including balancing damper means in the duct means, between the blower and the catch basin.

9. The invention according to claim 8 including flow measuring means between the blower and the catch basin.

10. The invention according to claim 9 including plural exhaust vents.

* * * * *